US011441534B2

(12) United States Patent
Fladby et al.

(10) Patent No.: US 11,441,534 B2
(45) Date of Patent: Sep. 13, 2022

(54) FLUID-DRIVEN LINEAR MOTOR

(71) Applicant: Flapump AS, Nittedal (NO)

(72) Inventors: Jostein Fladby, Nittedal (NO); Trygve Fladby, Oslo (NO); Sissel Fladby van Woensel Kooy, Oslo (NO)

(73) Assignee: Flapump AS, Nittedal (NO)

( * ) Notice: Subject to any disclaimer, the term of this patent is extended or adjusted under 35 U.S.C. 154(b) by 0 days.

(21) Appl. No.: 17/310,621

(22) PCT Filed: Feb. 18, 2020

(86) PCT No.: PCT/NO2020/050040
§ 371 (c)(1),
(2) Date: Aug. 13, 2021

(87) PCT Pub. No.: WO2020/171715
PCT Pub. Date: Aug. 27, 2020

(65) Prior Publication Data

US 2022/0145847 A1 May 12, 2022

(30) Foreign Application Priority Data

Feb. 22, 2019 (NO) ..... 20190241

(51) Int. Cl.
*F03C 1/007* (2006.01)
*F04B 47/08* (2006.01)
(Continued)

(52) U.S. Cl.
CPC ..... *F03C 1/007* (2013.01); *E21B 43/129* (2013.01); *F01B 11/001* (2013.01); *F04B 47/08* (2013.01);
(Continued)

(58) Field of Classification Search
CPC ..... F04B 9/105; F04B 47/04; F04B 47/08; F03C 1/013; F03C 1/007; E21B 43/129
See application file for complete search history.

(56) References Cited

U.S. PATENT DOCUMENTS 544,459 A * 8/1895 Champ ..... F01B 17/00 417/403
870,112 A * 11/1907 Lewis ..... F04B 9/105 91/313
(Continued)

FOREIGN PATENT DOCUMENTS

GB 1089919 A 11/1967
NO 170236 B 6/1992
WO WO 90/12197 A1 10/1990

OTHER PUBLICATIONS

International Search Report and Written Opinion of International Searching Authority for International Application No. PCT/NO2020/050040, dated May 27, 2020 (10 pages).
(Continued)

*Primary Examiner* — Dustin T Nguyen
(74) *Attorney, Agent, or Firm* — Nixon Peabody LLP

(57) ABSTRACT

A fluid-driven linear motor comprises a cylinder, a piston, and a piston rod connected to the piston. Two sides of the piston in the cylinder are alternately supplied with fluid from a slide valve arrangement. The slide valve arrangement includes a slide and a pilot rod adapted to alternately set a through-bore of a slide in fluid connection with the ends of the slide when the piston is located in its end positions. The pilot rod is provided with an extension rod adapted to move inside a bore of the piston and the piston rod, so that the stroke length of the linear motor can be extended. A pressure chamber is provided at the distal end of the pilot rod. The pressure chamber is adapted to hold the pilot rod with a
(Continued)

holding force when in its end positions until mechanical forces from the piston overcome said holding force.

18 Claims, 2 Drawing Sheets

(51) Int. Cl.

| | |
|---|---|
| ***E21B 43/12*** | (2006.01) |
| ***F01B 11/00*** | (2006.01) |
| *F03C 1/013* | (2006.01) |
| *F04B 9/105* | (2006.01) |
| *F15B 15/14* | (2006.01) |
| *F04D 13/04* | (2006.01) |

(52) U.S. Cl.
CPC ..... *F03C 1/013* (2013.01); *F04B 9/105* (2013.01); *F04D 13/04* (2013.01); *F15B 15/1447* (2013.01); *F15B 15/1457* (2013.01)

(56) References Cited

U.S. PATENT DOCUMENTS 2,087,713 A * 7/1937 Whiteside ..... F04B 47/08 417/404
2,204,120 A 6/1940 Coberly
2,245,501 A * 6/1941 Richardson ..... F04B 47/08 91/533
2,361,757 A * 10/1944 Fink ..... F04B 9/10 91/312
2,490,000 A * 11/1949 Cooper ..... F04B 47/08 417/399
3,374,713 A * 3/1968 Broughton ..... F01L 25/063 91/312
3,865,516 A 2/1975 Roeder
3,929,057 A * 12/1975 Kondo ..... F15B 11/076 92/143
4,062,639 A * 12/1977 Conlee ..... F01L 25/063 91/308
4,627,328 A * 12/1986 Renders ..... F04B 15/02 91/410
4,664,186 A 5/1987 Roeder
4,768,589 A 9/1988 Roeder
5,173,036 A * 12/1992 Fladby ..... F01B 11/001 417/403
5,494,102 A 2/1996 Schulte
5,651,666 A 7/1997 Martin
5,797,452 A 8/1998 Martin
2018/0156294 A1 6/2018 Löhken

OTHER PUBLICATIONS

Norwegian Patent Search Report for Norwegian Patent Application No. 20190241, dated Sep. 18, 2019 (2 pages).

* cited by examiner

FLUID-DRIVEN LINEAR MOTOR

CROSS-REFERENCE TO RELATED APPLICATIONS

This application is a U.S. National Stage of International Application No. PCT/NO2020/050040, filed Feb. 18, 2020, which claims priority to and the benefit of Norwegian Application No. 20190241, filed Feb. 22, 2019, both of which are incorporated by reference in their entirety.

FIELD OF THE INVENTION

The present invention relates to a fluid-powered linear motor. Linear motors may have many applications, and are often used to drive pumps.

BACKGROUND

From Norwegian patent 170236 there is known a pump driven by a linear motor, the linear motor comprising a cylinder and a piston, where the two sides thereof are alternatively supplied with fluid from a slide valve arrangement. The slide valve arrangement includes a slide accommodated in a chamber with a pilot rod coaxially mounted in a through bore in the slide. The pilot rod moves synchronously with the piston and controls the movement of the slide.

However, the linear motor disclosed in NO 170236 has an inherent limitation in that it cannot be designed with a long stroke length.

U.S. Pat. No. 4,664,186 discloses a fluid-driven pump located in a well.

U.S. Pat. Nos. 4,768,589, 3,865,516, 2,204,120, 5,797,452, 5,494,102, 2,490,000 show the state of the art in the field.

SUMMARY OF THE INVENTION

It is an object of the present invention to provide a linear motor of the type mentioned above which has a longer stroke length than previously known designs.

This is obtained in a fluid-powered linear motor according to the following claims. The inventive linear motor may be designed with stroke lengths of several meters and may therefore find applications for driving downhole pumps in wells where a long stroke length is essential for operating the pump in an efficient way.

BRIEF DESCRIPTION OF THE DRAWINGS

The invention will now be described in detail in reference to the appended drawings, in which.

DETAILED DESCRIPTION

Figure 1:
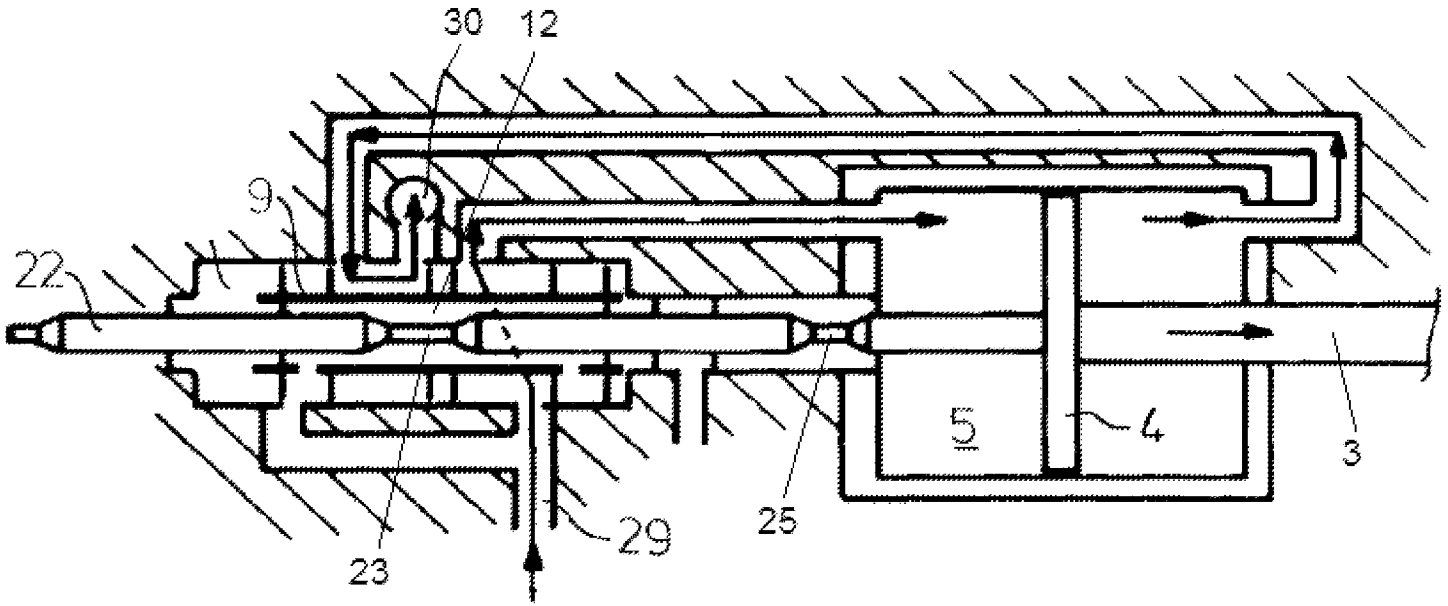
Fig. 1 Prior Art
FIG. 1 is a sectional view through a prior art fluid-driven linear motor.

FIG. 1 shows a schematic view of a prior art fluid-driven linear motor. The motor includes a piston 4 in a cylinder 5 which is supplied with a drive fluid (entering through the fluid inlet 29) controlled by a slide valve arrangement 8 with a slide 9 which is moved between its end positions by means of the drive fluid. A pilot rod 22 connected to the piston 4 is controlling the supply of drive fluid to the respective sides of the slide 9. The pilot rod 22 is slideable mounted in a bore 12 through the slide 9 and includes regions 23-25 of reduced diameter acting as valves. The piston 4 may be connected to a pump or another driven device via the piston rod 3.

This linear motor has proved to be reliable and efficient. A detailed account of how this motor functions may be found in the above-mentioned Norwegian patent 170236.

Figure 2:
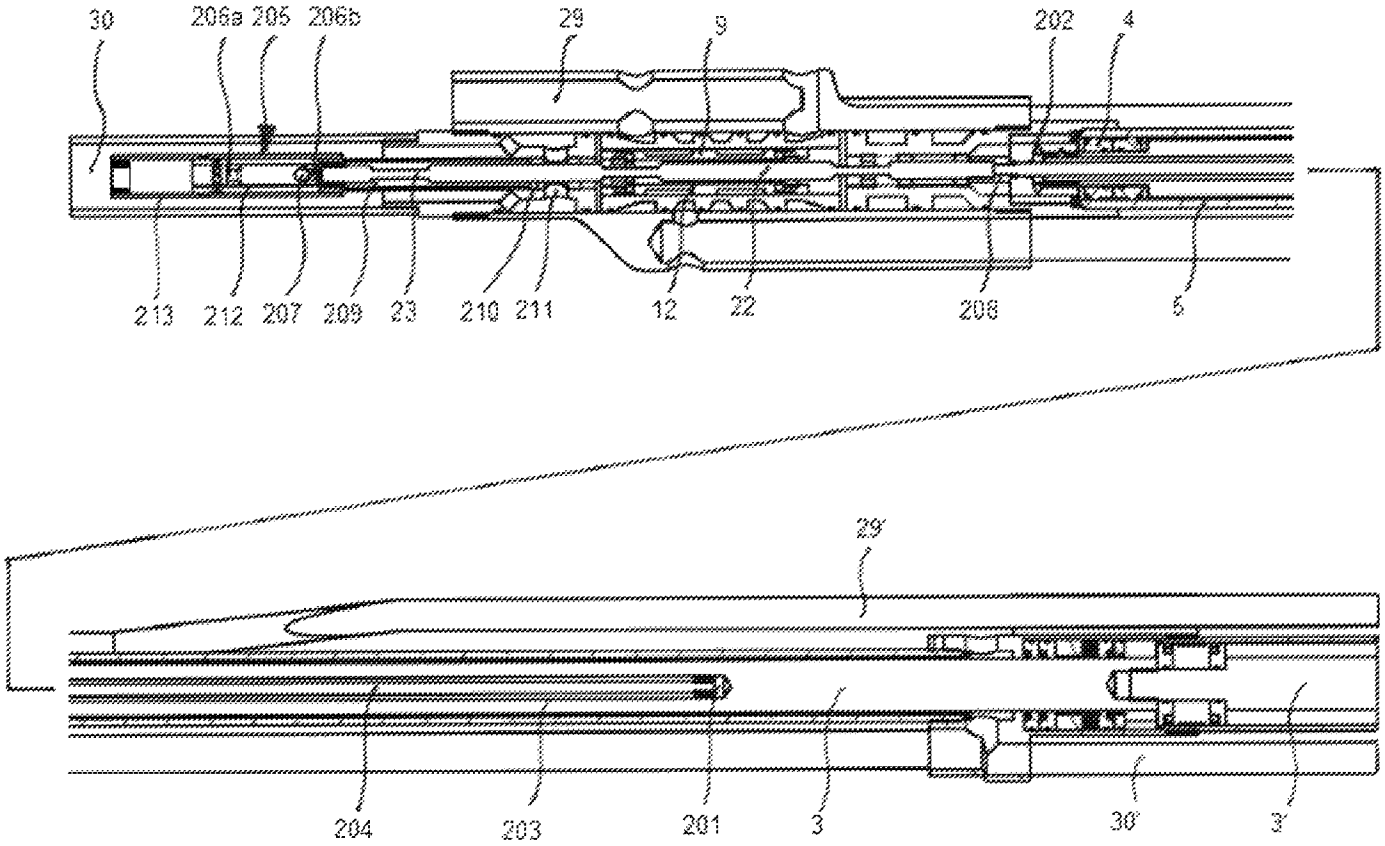
FIG. 2 is a schematic illustration of a linear motor according to the present invention.

FIG. 2 shows how the linear motor shown in FIG. 1 may be modified in order to obtain a longer stroke length. The figure shows an arrangement with a linear motor including a piston 4 in a cylinder 5. The linear motor is supplied with drive fluid through the fluid inlet port 29, and with an outlet port 30 for the drive fluid. The arrangement in the figure is intended to be connected in series to at least one more cylinder/piston. Thus, the piston rod 3 is connected to a drive rod 3' which here is intended to be connected to an oil pump (not shown), and with a corresponding drive rod and cylinder/piston on the other side of the pump, i.e. forming a symmetrical arrangement with the pump in the middle. In this way the load on the piston rod is lowered. The figure shows pipelines 29' and 30' connecting the cylinder 5 to at least one other cylinder (not shown).

The modification for obtaining longer stroke length involves two components. The first modification is that the pilot rod 22 is provided with an extension rod 204 that is arranged slideable through the piston 4 and into a bore 203 inside the piston rod 3. The extension rod is connected to the pilot rod in a junction 208 and is terminated in an end stopper 201 in its distant end.

When the piston 4 is moving towards the right hand end position, the extension rod, and thus the connected pilot rod, will remain stationary while the piston and piston rod are sliding on the extension rod. When the end stopper 201 hits the end collar 202 of the bore 203, the pilot rod will start moving on with the piston and piston rod and ultimately change the direction of fluid acting on the slide 9. This means that the slide will change position and in turn change the direction of fluid flow acting on the piston 4. Then, the piston 4 and piston rod 3 will start to move in the opposite direction, i.e. towards the left hand side of the cylinder 5. The pilot rod will stand stationary until the collar 202 hits the junction 208 connecting the pilot rod 22 to the extension rod 204. From then on the pilot rod will move together with the piston and piston rod, and ultimately change the fluid flow to the slide, which will change its position and reverse the flow to the cylinder 5, whereupon the cycle reiterates.

The second modification is the addition of a pressure chamber 209 isolating the left hand end portion of the pilot rod 22 from the surrounding fluids. The pressure chamber 209 is provided with a pressure control device 205. The pressure control device includes a hollow piston 212 slidable mounted inside a damping cylinder 213. The hollow piston 212 is provided with narrow openings 206*a*, 206*b* at each end thereof. The openings 206*a, b* form valve seats inside the hollow piston for receiving a ball 207.

The linear motor is receiving drive fluid through the input port 29, while the output port 30 is at the output pressure of the motor. The fluid delivered by the motor will provide some output pressure, in particular if the motor is mounted vertically in a well. In case the fluid motor is not mounted vertically, the output port 30 may be provided with a restriction (not shown) securing a proper back pressure.

The pressure control device is at the pressure of the returning drive fluid received through the left hand opening 206*a*. When the pilot rod is moving towards the pressure control device, it will press fluid out of the pressure chamber 209 through the opening 206*b* until reaching the left hand end position. When the piston 4 reverses and starts to travel in the opposite direction, the pilot rod 22 will try to follow the piston. This may happen due to the friction between the pilot rod and the piston. Another reason may occur in cases where the linear motor is mounted in a vertical position, i.e. the pilot rod will tend to sink due to gravitational forces. However, the opening 206*b* now becomes closed by the ball 207, whereupon the pressure inside the pressure chamber will be lowered holding (sucking) at the end of the pilot rod. The pilot rod will be held stationary until mechanical forces pulling on the pilot rod from the piston overcome the force from the pressure chamber. This will happen when the collar on the piston rod hits the end stopper on the extension. From then on the pilot rod will move with the piston.

The pressure chamber 209 is also provided with a restriction 210 fitting the outer diameter of the pilot rod 22, and a side opening 211 which is arranged to cooperate with the region 23 of reduced diameter on the pilot rod 22. This arrangement allows the pressure inside the pressure chamber 209 to equalise with the output pressure when the pilot rod reaches its end position preventing the pilot rod from snapping back when the mechanical forces acting on the pilot rod cease.

The pressure chamber with its pressure control device allows the linear motor to be mounted in any orientation while securing that the pilot rod is held in its end positions until the right moments for moving.

When the piston 4 starts moving in the opposite direction, it will exert a pulling force on the pilot rod that could affect the correct position or movement of the pilot rod. However, the pressure chamber will prevent this, as the pressure on the outlet of the linear motor will continuously affect the ball 207 pressing the ball against the opening 206*b*. This prevents the pilot rod 22 from moving until mechanically pushed by the piston 4 hitting the junction 208. The ball will then move, as the pressure inside the pressure chamber increases, and open the opening 206*b*. From then on the pilot rod 22 will follow the piston 4.

In addition to said holding action, the pressure chamber 209 will also dampen the shock when the pilot rod 22 comes to its end position, specifically by the hollow piston 212 being pushed into the damping cylinder 213.

The action of the pressure chamber could also be realized using other means, such as a magnetic holding device or a mechanical device clamping to the pilot rod.

The invention claimed is:

1. A fluid-driven linear motor, comprising:

a cylinder;

a piston having a piston rod, the piston being within the cylinder, the piston and the piston rod being provided with a bore, the bore including a collar adjacent to the piston;

a slide valve arrangement for alternately supplying two sides of the piston with a fluid in the cylinder, the slide valve arrangement including a slide accommodated in a chamber and which is shifted between end positions controlled by a pilot rod coaxially mounted in a through-bore in the slide, the pilot rod being adapted to alternately place the through-bore in fluid connection with the ends of the slide when the piston is located in its end positions;

an extension rod having a first end connected to the pilot rod at a junction and a second end terminating in an end stopper, the extension rod sliding inside the bore of the piston and piston rod, the junction and the end stopper respectively engaging the collar during operation of the pilot rod; and a pressure chamber at a distal end of the pilot rod, the pressure chamber being adapted to hold on the pilot rod with a holding force when the pilot rod is in an end position until mechanical forces from the piston overcome the holding force.

2. The linear motor according to claim 1, wherein the pressure chamber is connected to a pressure control device that includes a hollow piston with openings at each end thereof, wherein one opening of the hollow piston is in fluid connection with the pressure chamber, the other opening of the hollow piston is connected to an output pressure of the linear motor, the openings of the hollow piston forming valve seats for a ball located inside the hollow piston.

3. The linear motor according to claim 2, wherein the hollow piston is slideably mounted inside a damping cylinder.

4. A fluid-driven linear motor, comprising:

a cylinder;

a piston having a piston rod, the piston located within the cylinder, the piston and the piston rod having a bore extending therethrough, a collar provided within the bore and adjacent to the piston;

a slide valve arrangement for alternately supplying two sides of the piston with a fluid in the cylinder, the slide valve arrangement including a pilot rod;

an extension rod having a first end connected to the pilot rod at a junction and a second end having an end stopper, the extension rod undergoing reciprocating movement inside the bore of the piston and piston rod such that the junction and the end stopper move back and forth relative to the collar during operation of the linear motor; and a pressure chamber adapted to temporarily hold the pilot rod with a holding force when the pilot rod is in an end position until mechanical forces associated with the piston overcome the holding force.

5. The linear motor according to claim 4, wherein an end region of the pilot rod opposing the junction is held by the pressure chamber.

6. The linear motor according to claim 4, wherein the pressure chamber dampens the shock of the pilot rod at an end of a stroke of the reciprocating movement of the pilot rod and the extension rod.

7. The linear motor according to claim 4, further including a pressure control device associated with the pressure chamber, the pressure control device including a hollow piston.

8. The linear motor according to claim 7, wherein a first opening of the hollow piston is in fluid connection with the pressure chamber, and a second opening of the hollow piston is connected to an output pressure of the linear motor.

9. The linear motor according to claim 8, wherein the first and second openings of the hollow piston form valve seats.

10. The linear motor according to claim 8, wherein the valve seats are curved for receiving a ball located inside the hollow piston.

11. The linear motor according to claim 7, wherein the hollow piston is slideably mounted inside a damping cylinder.

12. The linear motor according to claim 4, wherein the slide valve arrangement includes a slide accommodated in a chamber and which is shifted between end positions controlled by the pilot rod that is coaxially mounted in a through-bore in the slide.

13. The linear motor according to claim 12, wherein the pilot rod is for alternately placing the through-bore in fluid connection with the ends of the slide when the piston is located in its end positions for supplying the two sides of the piston with the fluid.

14. A fluid-driven linear motor, comprising:

a cylinder;

a piston having a piston rod, the piston located within the cylinder, the piston and the piston rod having a bore extending therethrough, a collar provided within the bore;

a slide valve arrangement for alternately supplying two sides of the piston with a fluid in the cylinder, the slide valve arrangement including a pilot rod;

an extension rod having a first end connected to the pilot rod at a junction and a second end having an end stopper, the extension rod undergoing reciprocating movement inside the bore of the piston and piston rod such that the junction and the end stopper move back and forth relative to the collar during operation of the linear motor; and a holding device adapted to temporarily provide a holding force on the pilot rod when the pilot rod is in an end position until mechanical forces associated with the piston overcome the holding force.

15. The linear motor according to claim 14, wherein the holding device includes a pressure chamber having a pressure control device, the pressure control device including a hollow piston that applies pressure to an end region of the pilot rod.

16. The linear motor according to claim 15, wherein the hollow piston is slideably mounted inside a damping cylinder.

17. The linear motor according to claim 15, wherein a first opening of the hollow piston is in fluid connection with the pressure chamber, and a second opening of the hollow piston is connected to an output pressure of the linear motor.

18. The linear motor according to claim 17, wherein the first and second openings of the hollow piston form valve seats that receive a ball structure that moves within the hollow piston.

* * * * *